US006078026A

United States Patent [19]

West

[11] Patent Number: 6,078,026

[45] Date of Patent: Jun. 20, 2000

[54] THERMAL WARMING BLANKET FOR PATIENT TEMPERATURE MANAGEMENT

[76] Inventor: Arlen C. West, 921 Sunset Dr., East Peoria, Ill. 61611

[21] Appl. No.: 09/273,907

[22] Filed: Mar. 22, 1999

Related U.S. Application Data

[60] Provisional application No. 60/079,455, Mar. 26, 1998.

[51] Int. Cl.[7] ..... H05B 3/34

[52] U.S. Cl. ..... 219/212; 219/528; 219/549; 607/96

[58] Field of Search ..... 219/212, 527, 219/535, 515, 211, 529, 386, 387, 528, 549; 607/96, 108–111

[56] References Cited

U.S. PATENT DOCUMENTS

| | | | |
|---|---|---|---|
| 2,342,744 | 2/1944 | McCready | 219/211 |
| 3,417,229 | 12/1968 | Shompho | 219/528 |
| 3,422,244 | 1/1969 | Lauck | 219/212 |
| 3,808,403 | 4/1974 | Kanaya et al. | 219/528 |
| 3,878,362 | 4/1975 | Stinger | 219/528 |
| 3,989,924 | 11/1976 | Kurtzer | 219/211 |
| 4,042,803 | 8/1977 | Bickford | 219/211 |
| 4,198,562 | 4/1980 | Mills et al. | 219/505 |
| 4,250,398 | 2/1981 | Ellis et al. | 219/549 |
| 4,279,255 | 7/1981 | Hoffman | 607/112 |
| 4,293,763 | 10/1981 | McMullan | 219/528 |
| 4,335,725 | 6/1982 | Geldmacher | 607/96 |
| 4,358,668 | 11/1982 | McMullan et al. | 219/528 |
| 4,429,215 | 1/1984 | Sakai et al. | 219/528 |
| 4,507,877 | 4/1985 | Vaccari et al. | 36/2.6 |
| 4,713,531 | 12/1987 | Fennekels et al. | 219/545 |
| 5,714,738 | 2/1998 | Hauschulz et al. | 219/535 |
| 5,891,189 | 4/1999 | Payne, Jr. | 607/108 |

FOREIGN PATENT DOCUMENTS

| | | |
|---|---|---|
| 2041047 | 1/1971 | France . |
| 2577390 | 8/1986 | France . |
| 2769507 | 4/1999 | France . |
| 4140507 | 4/1993 | Germany . |
| 8-106895 | 4/1996 | Japan . |

*Primary Examiner*—John A. Jeffery
*Attorney, Agent, or Firm*—Husch & Eppenberger, LLC; Robert E. Muir

[57] ABSTRACT

A disposable blanket for warming a patient including a power cord with a plug connected to the blanket, a second cord connected to the power cord and the blanket; a wire matrix connected to the power cord and the second cord; a power source; and a thermocouple. The blanket is plugged into a portable case containing the power source. The blanket is thrown away after use.

4 Claims, 7 Drawing Sheets

THERMAL WARMING BLANKET FOR PATIENT TEMPERATURE MANAGEMENT

PRIORITY

This application claims the benefit of U.S. Provisional Application No. 60/079,455 filed Mar. 26, 1998.

FIELD OF THE INVENTION

This invention relates generally to medical devices and more particularly a thermal warming blanket to be used for patient temperature management.

BACKGROUND OF THE INVENTION

Peri-operative or peri-trauma hypothermia can have serious side effects for any patient. Negative effects include a decrease in cardiovascular stability, an increase in oxygen consumption, and a decrease in resistance to infection. The benefits of maintaining normothermia are well documented. Four recent publications are as follows:

Frank, S. M. et al.; Perioperative Maintenance of Normothermia Reduces the Incidence of Morbid Cardiac Events. *JAMA,* 14:277, 11271–1134, April, 1997.

Cheney, F. W.; Should Normothermia be Maintained During Major Surgery? *JAMA,* 14:277, 1165–1166, April, 1997.

Kurz, A.; Perioperative Normothermia to Reduce the Incidence of Surgical-Wound Infection and Shorten Hospitalization. *New England Journal of Medicine,* 19:334, 1209–1213, May, 1996.

Sessler, D.; Mild Perioperative Hypothermia. *New England Journal of Medicine*, 24:336, June, 1997.

Many methods have been employed to warm peri-operative and peritrauma patients including heat lamps, water mattresses, warmed hospital blankets and warm air blowers. These have frequently proven to be impractical under usual operating constraints.

The most common method of treating hypothermia, heated hospital blankets, requires six or more applications before reaching normothermia. The small amount of heat retained by a cotton blanket quickly dissipates, thereby requiring the patients to rewarm themselves. Although warm blankets are simple and safe, they are inconvenient and time-consuming for the nursing staff.

A warm air heated blanket system is sold by Augustine Medical, Inc. under the name Bair Hugger™ Patient Warming System. This system is effective but requires a heavy heater/blower system that in many instances is impractical in confined hospital spaces. Also, this system is not desirable for patients with open wounds because the blower system can circulate germs.

A less common rewarming technique is the use of a water circulating mattress. The equipment is heavy, complex, expensive, and may leak. None of these warming systems are usable by paramedic rescue units or in an emergency room, where they are often needed most.

It is desirable to provide a system for warming patients which system overcomes one or more of the above described disadvantages.

It is an object of this invention to provide a disposable, electric cover for use in hospitals and emergency situations.

Another object of this invention to provide a portable power source to be connected to the electric blanket.

These, and other objects and advantages of the present invention, will become apparent as the same becomes better understood from the Detailed Description when taken in conjunction with the accompanying drawings.

SUMMARY OF THE INVENTION

In accordance with the present invention there is provided a disposable blanket for patient use including a cover sized to cover the body of a human patient; a wire matrix in communication with the cover; a power cord in communication with the wire matrix; a second cord extending to adjacent the wire matrix; and means in communication with the second cord for closely regulating the temperature of the blanket and including a sensor adjacent the wire matrix.

The present invention treats peri-operative and peri-trauma hypothermia by creating a personal environment of comforting warmth. The embodiment precludes patient hypothermia by providing patient warmth by means of a substantially fixed temperature disposable blanket which operates at approximately 100 degrees Fahrenheit. The blanket is advantageously heated by a rechargeable 12 volt direct current battery package. A thermostat is advantageously located in the middle of the blanket and is connected to a temperature controller which controls the flow of current so that the temperature of the blanket remains at about 100 degrees Fahrenheit.

In accordance with another aspect of the present invention there is provided a case for a power source for a blanket including a plurality of vents; a power source; and a receptacle for a plug in communication with the power source.

BRIEF DESCRIPTION OF THE DRAWINGS

Reference is made to the drawings which illustrate the best known mode of carrying out the invention.

DETAILED DESCRIPTION

Figure 1:
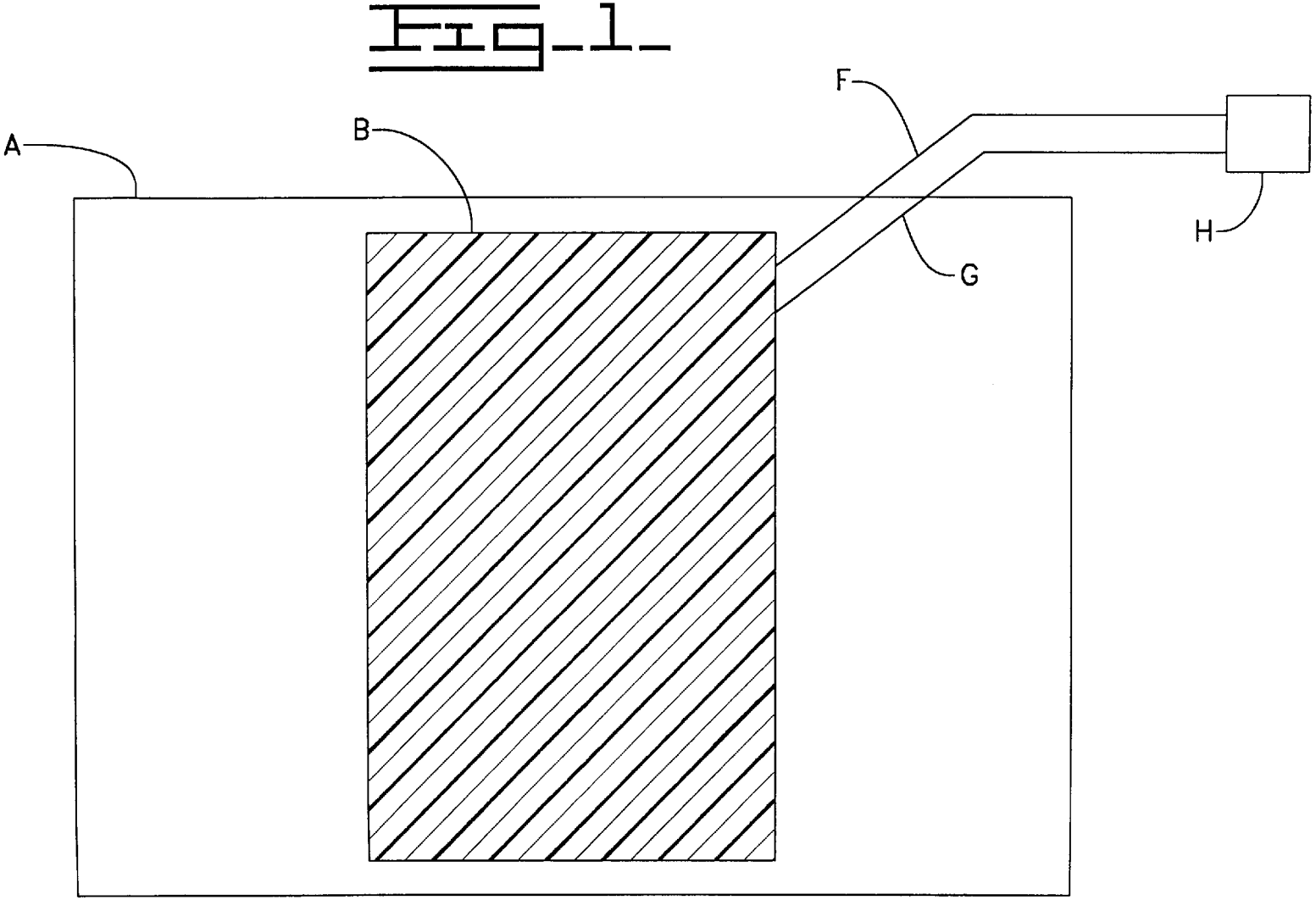
FIG. 1 is a plan view showing the construction of the blanket prior to complete assembly.

Reference is now made more particularly to the drawings which illustrate the best presently known mode of carrying out the invention and wherein similar reference characters indicate the same parts throughout the several views. FIG. 1 shows a disposable blanket A which advantageously is 54 inches wide and 40 inches long and contains an imbedded heating pad structure B which advantageously is 21 inches wide and 36 inches long. The blanket A is constructed of a material which is a non-woven polypropylene base fabric such as is employed in disposable surgical drapes and gowns. Other material may be used, but any alternate material must meet the flammability requirements of the National Fire Protection Association Standard NFPA 702-1980.

Figure 2:
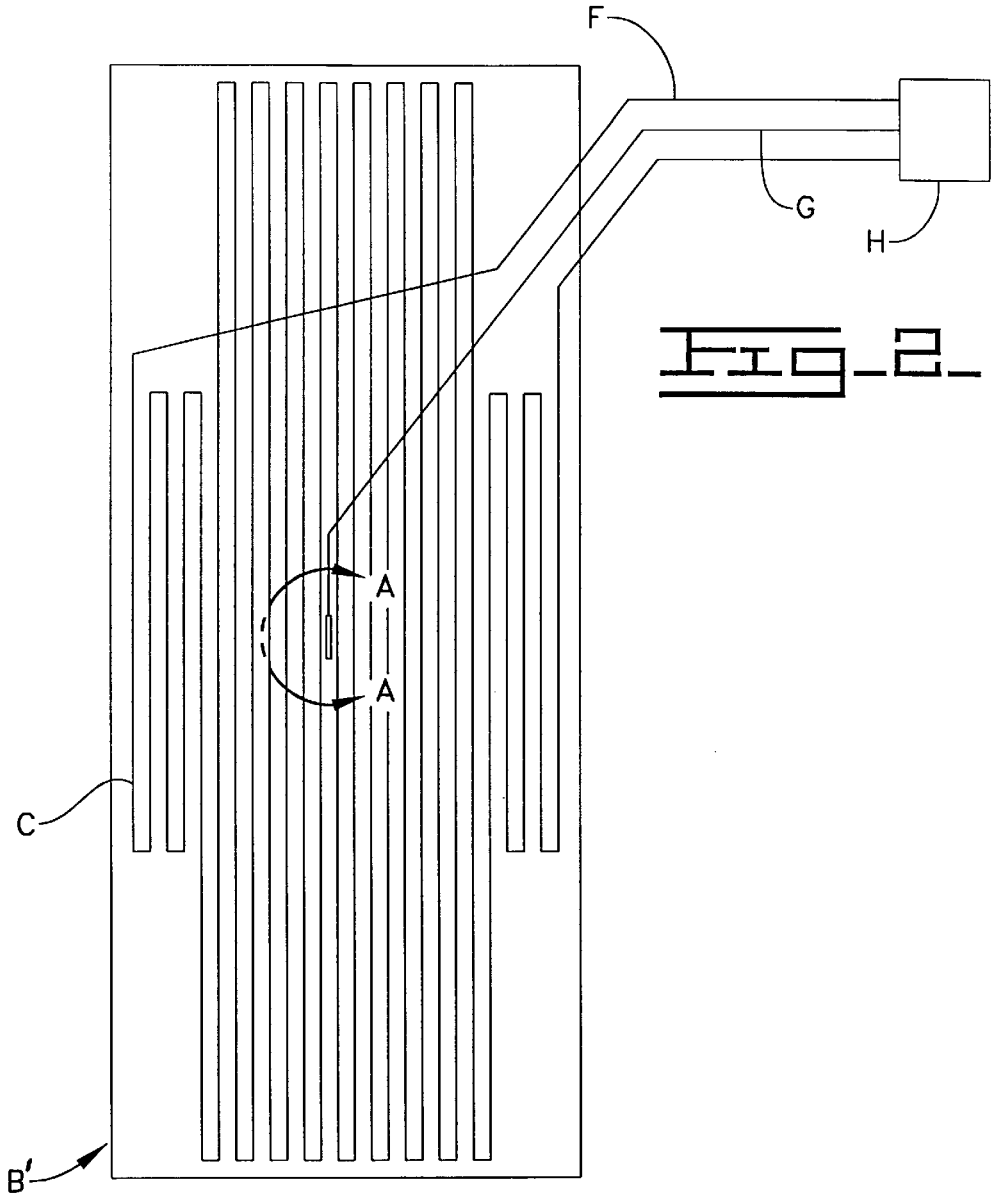
FIG. 2 is an illustration of the heating element matrix.

The heating pad structure B includes a heating element matrix shown in FIG. 2. The heating element matrix is constructed of wires C that are encapsulated between two thin sheets of non-flammable reflective plastic film B'. The film B' is CURLAM® Grade 8019-I protective packaging film which is a flexible, non-formed web which meets the requirements for a food contact material under the Food Additive Regulations. CURLAM® is a registered trademark of Curwood, Inc. of Oshkosk, Wis. In the preferred embodiment shown in FIG. 6, the matrix is placed between the plastic sheets and stitched into the blanket. In an alternative embodiment shown in FIG. 7 a glue is used to secure the film B' and encapsulate the wires C. The encapsulating glue is Scotch-Grip 4475 Plastic Adhesive. When this glue is thoroughly dry it is not flammable and will burn only when subjected to a flame or temperature sufficient to cause thermal decomposition of the adhesive, which occurs at about 350 degrees Fahrenheit. The wire C is 24 gauge plastic coated seven strand hookup wire. The heating element matrix advantageously contains 72 feet of wire placed as 30 inch and 36 inch loops as illustrated in FIG. 2 within the layers of the plastic film B'. The encapsulated heating element matrix is waterproof and the blanket will function even when submerged in water.

Figure 2A:
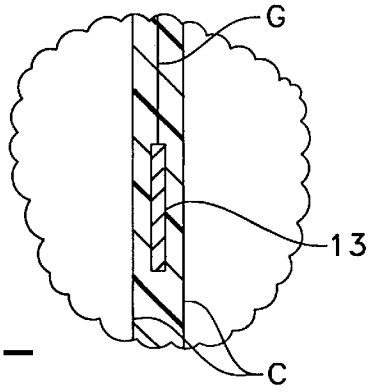
FIG. 2A is an enlarged, cross-sectional illustration of a thermocouple taken along lines A—A in FIG. 2.

Temperature of the blanket is regulated at approximately 100 degrees Fahrenheit by a temperature controller (not shown) and, advantageously, a thermocouple 13 shown in FIG. 2A. Devices other than the thermocouple may be used as a thermostat. In this preferred embodiment the temperature controller is advantageously a Fenwal Temperature Controller sold by Fenwal, Inc. of Ashland, Mass., having an accuracy of +/−1 degree Fahrenheit. This results in an effective blanket temperature in the range of +/−5 degrees Fahrenheit. The temperature controller includes a circuit board (not shown) which is located inside a portable rubber-plastic case 11 and which acts as a SPST relay, with normally open contacts. The circuit board is operatively connected to a pair of sealed, maintenance free, rechargeable 12 volt batteries (not shown) inside the portable rubber-plastic case 11 to regulate the flow of current to the heating matrix shown in FIG. 2. The thermocouple 13 is advantageously in the form of a probe encapsulated along with the heating matrix as described above.

A power cord F is an integral part of the blanket A and is advantageously disposable with the blanket. Another cord G is connected to the thermocouple 13. Cords F and G terminate in a male plug H. In the illustrated embodiment the cords F and G are 18 gauge and 10 feet in length. The cords F and G have been described as separate; however they may be packaged inside a single sheath or covering. The plug H is for connection to a labeled female receptacle 16 on the front of a supply power pack 10 best seen in FIG. 3.

Figure 3:
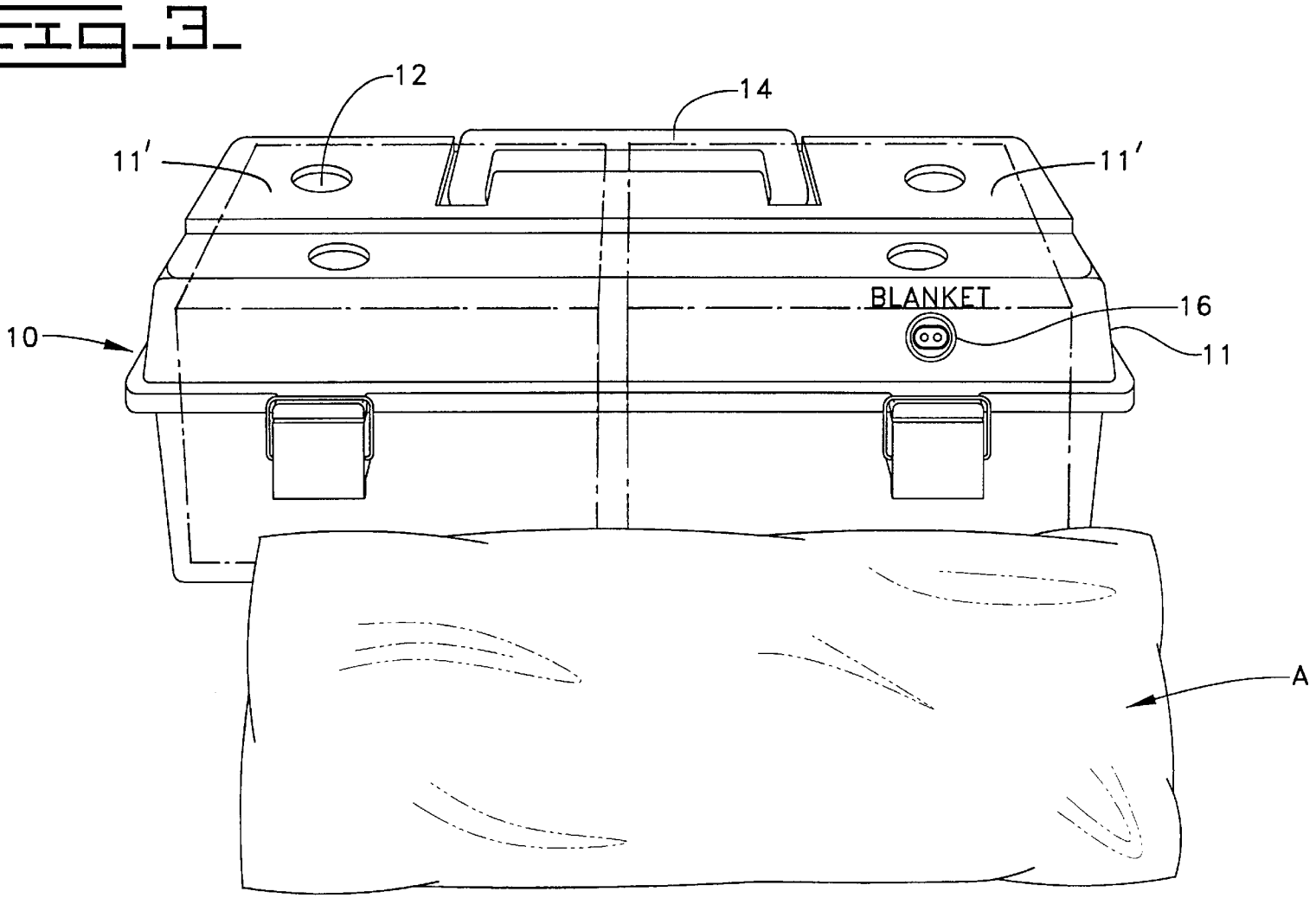
FIG. 3 is an illustration of a power case and the blanket.

The supply power pack 10 shown in FIG. 3 includes the pair of sealed, maintenance free, rechargeable 12 volt batteries shown in phantom lines at 11' inside the portable rubber-plastic case 11. Together the case 11 and batteries weigh about 30 pounds. The case 11 is arranged so that it cannot be opened in the field. Five circular vents 12 are provided on the top of the case 11, two at each end and one beneath its carrying handle 14. The socket 16, labeled BLANKET in FIG. 3, is located at the upper right-front of the case 11 and accepts the plug H. Each of the batteries has a 19 amp-hours rating for a total of 38 amp-hours. The blanket A has a maximum power draw of 6.5 amps. With fully charged batteries, the blanket will reach its target temperature (i.e. 100 degrees Fahrenheit or 38 degrees Celsius) approximately 5 minutes and will remain heated for five to eight hours.

Figure 4:
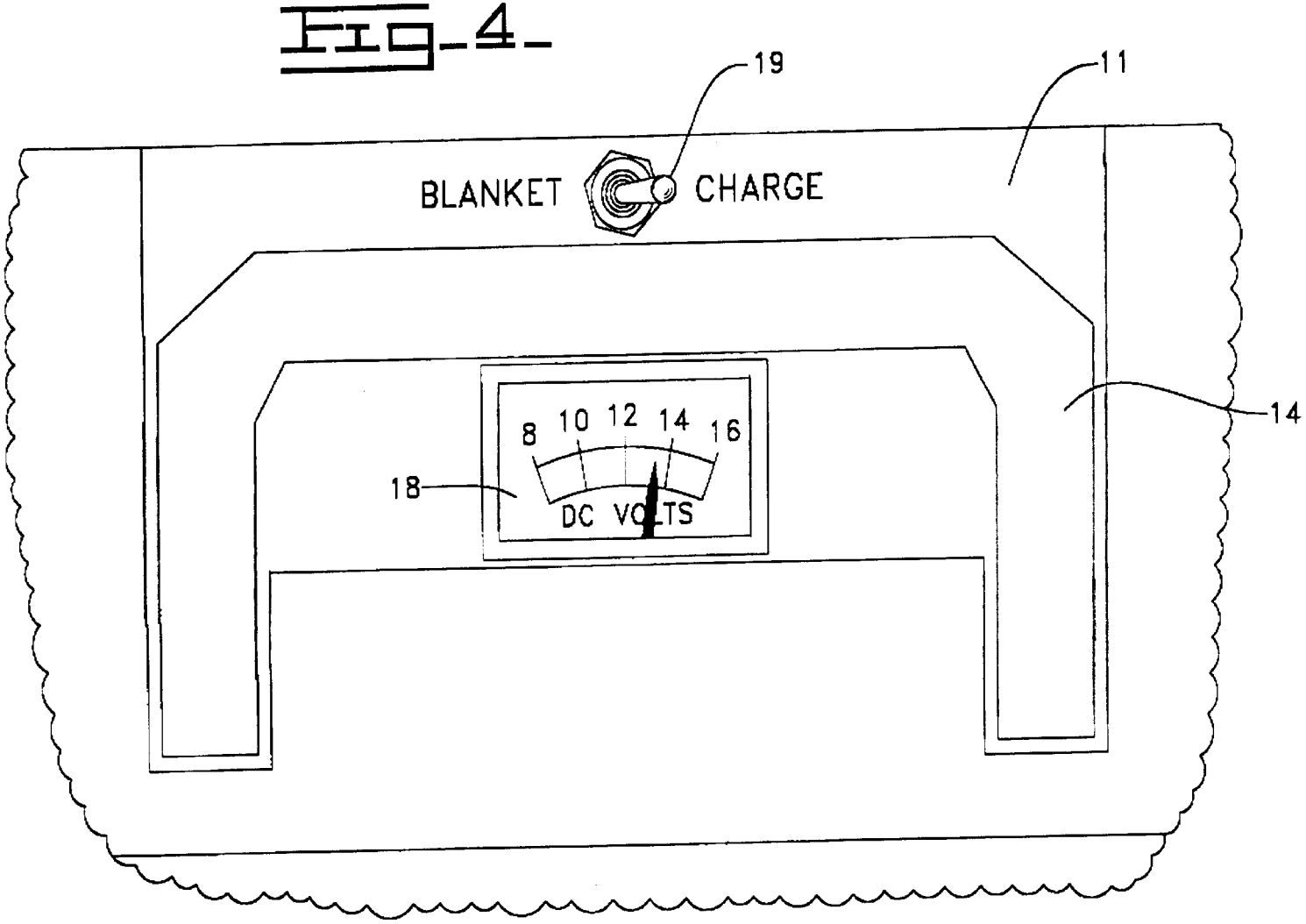
FIG. 4 is an illustration of a portion of the top of the power case on a larger scale than FIG. 3.

As shown in FIG. 4, a battery condition gauge 18 is located on the case 11 and indicates when the batteries require recharging. A socket (not shown) at the rear of the case 11 accepts a charger connector. A toggle switch 19 is arranged so that it is not possible to operate the battery charger when the blanket A is in use; and, likewise when charging, the power connection to the blanket is terminated.

For this purpose the toggle switch 19 has BLANKET and CHARGE positions, as shown in FIG. 4.

Figure 5:
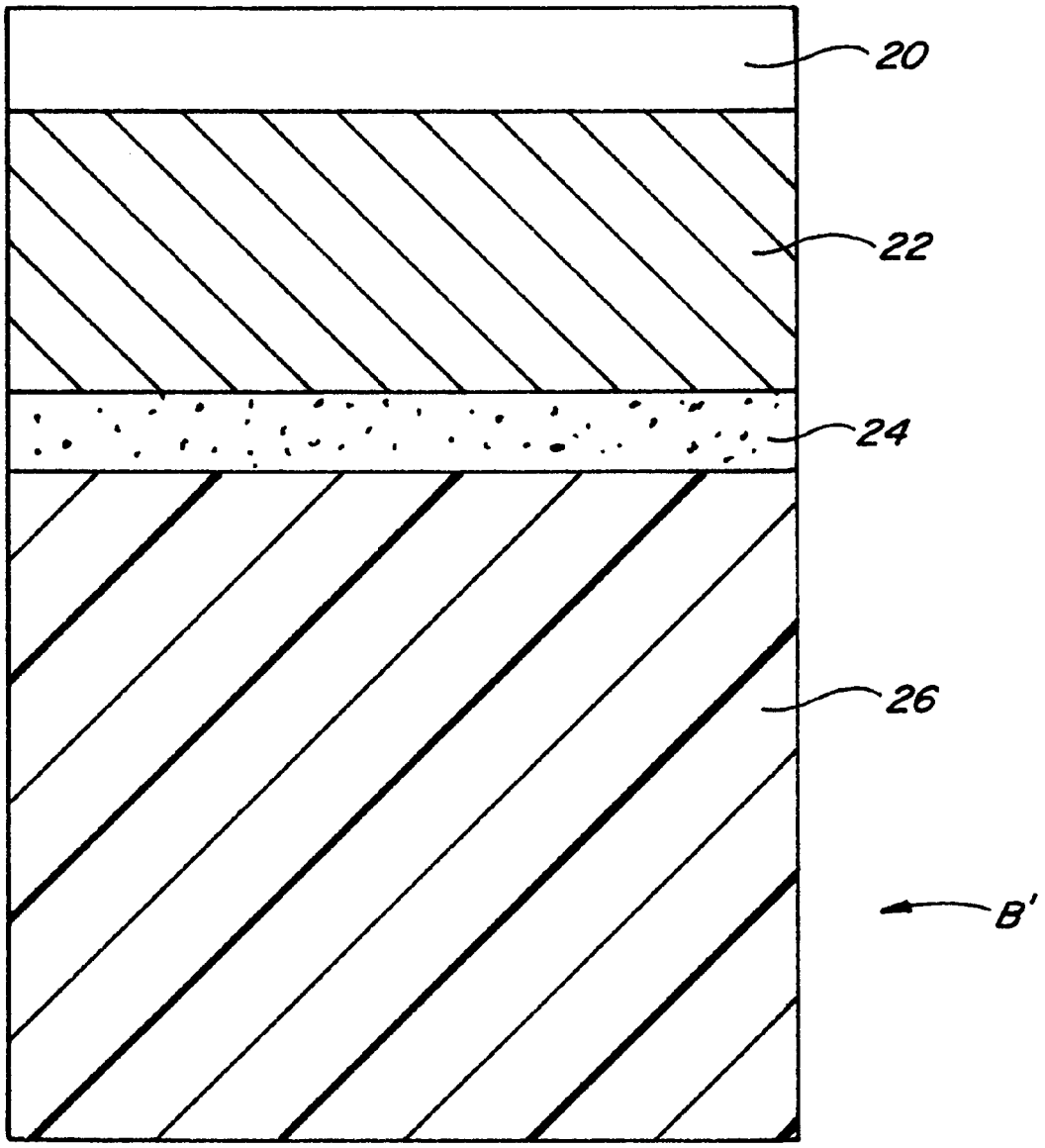
FIG. 5 is a sectional view taken along line B—B in FIG. 6.
Figure 6:
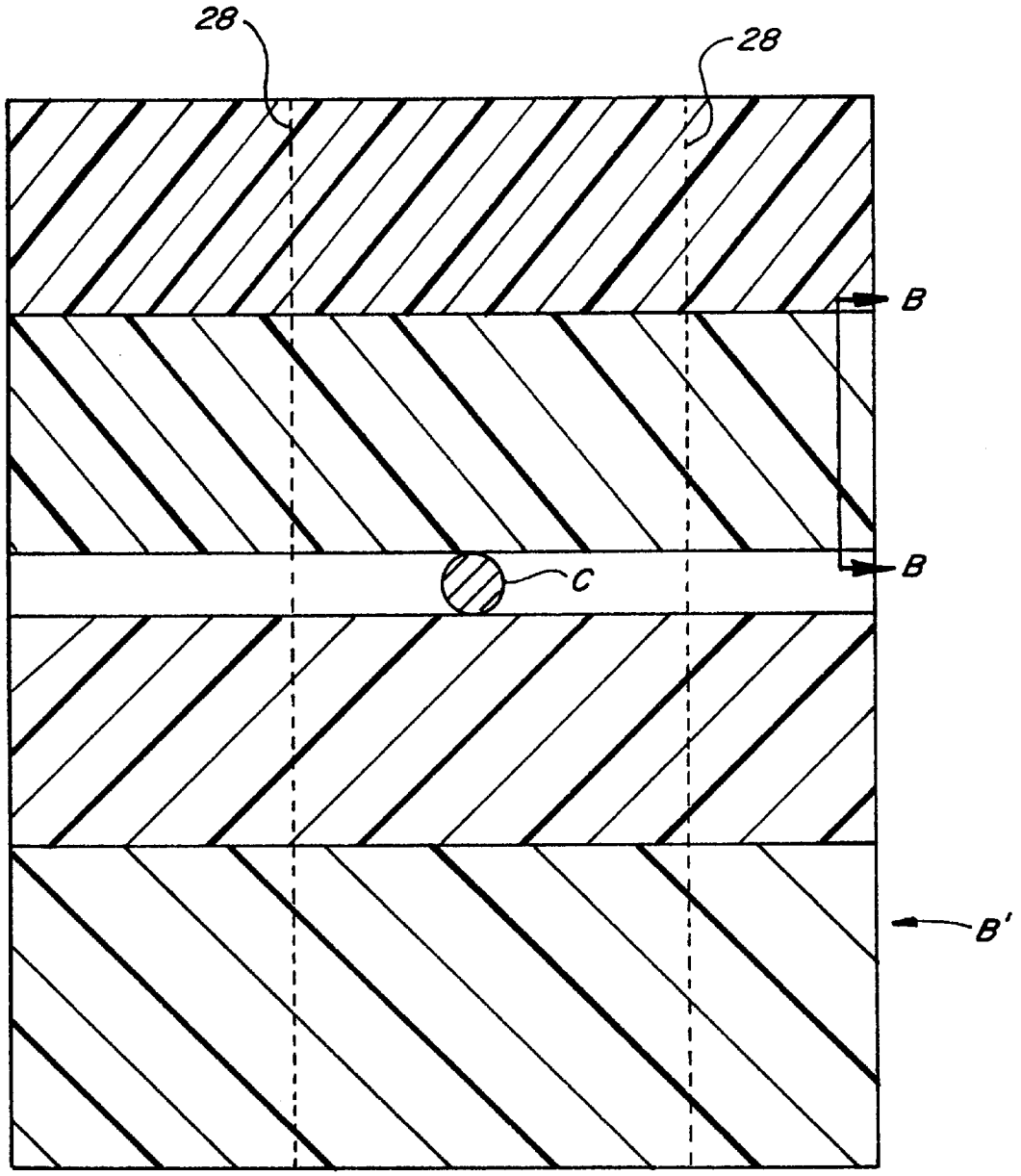
FIG. 6 is a sectional view of the blanket showing the stitching for holding a wire.
Figure 7:
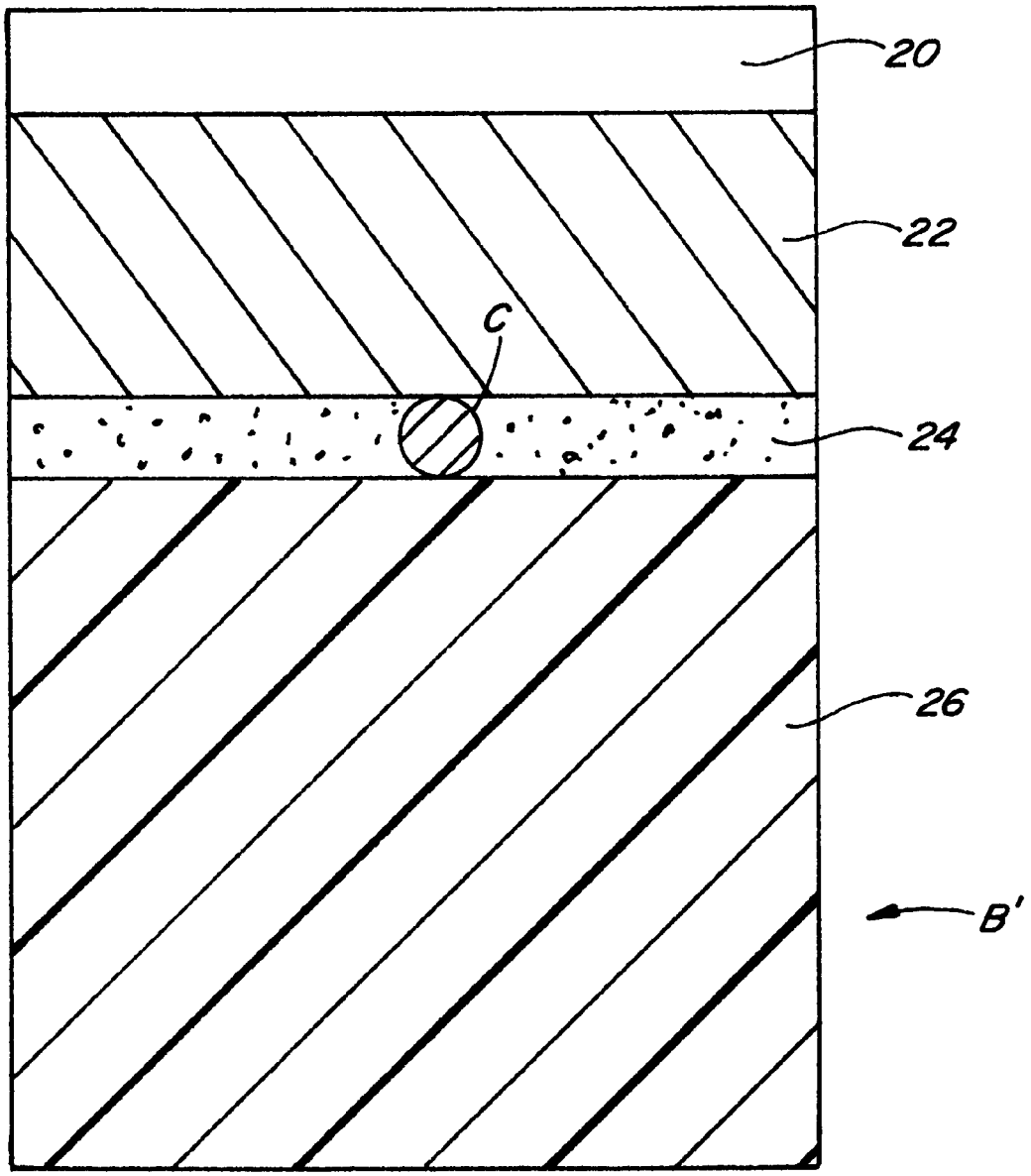
FIG. 7 is a sectional view of the blanket showing the wire held by an adhesive.

FIG. 5 is a sectional view along B—B of FIG. 6 of the CURLAM® Grade 8019-I protective packaging film which includes a layer 26 of 2.5 mil linear low density polyethelene (LLDPE), and a layer 22 of 48 ga. metallized polyethylene terephthalate (PET) held by an intermediate layer 24 of adhesive. Conveniently the layer 22 can have a surface print 20.

In use, the blanket A is for patient heat at approximately 100 degrees Fahrenheit (38 degrees Celsius). It is designed to be disposable and is intended for single patient use only because it is non-sterile. For best results, one would place the blanket A in direct contact with the patient and place the patient's regular blanket or sheet over the blanket A. After the blanket A is in place, one would place the plug H into the socket 16 which is labeled BLANKET on the case 11. One would ascertain that the switch 19 is set to the BLANKET position as shown in FIG. 4. The blanket A will not heat if the switch 19 is in the CHARGE position. Preferably one would recharge the batteries in the supply power pack 10 after each use. For recharging one would ascertain that the switch is in the CHARGE position shown in FIG. 4. Medical personnel should monitor the patient's temperature and vital signs regularly.

It is now deemed apparent that there has been described a disposable warming blanket. The thermocouple and cord are permanently attached to the power supply and are not disposable. A supply power pack has been described; however, other ways of delivering direct current to the blanket are contemplated, such as a cigarette lighter receptacle in a vehicle. While a preferred embodiment of the invention has herein been illustrated and described, this has been done by way of illustration and not limitation, and the invention should not be limited except as required by the scope of the appended claims.

I claim:

1. A disposable blanket for one-time patient use including a sheet of plastic film made of a flexible, non-formed web of linear low density polyethylene and metallized polyethylene terephthalate; a heating element matrix on and secured to the sheet of plastic film; a cover for covering both sides of the sheet of plastic film; the cover comprising two sheets of non-woven polypropylene fabric; and means for supplying a direct current power to the heating element matrix.

2. A disposable blanket according to claim 1 wherein there are two sheets of said plastic film and the heating element matrix is between the two sheets of plastic film.

3. A disposable blanket according to claim 1 including a stitching for securing the heating element matrix on the sheet of plastic film.

4. A disposable in accordance with claim 1 including an adhesive for securing the heating element matrix on the sheet of plastic film.

* * * * *